United States Patent [19]

Wallace

[11] Patent Number: 4,972,527

[45] Date of Patent: Nov. 27, 1990

[54] SAFETY HELMET WITH FIN CUSHIONING

[75] Inventor: Robert S. Wallace, 823 S. Longwood Ave., Los Angeles, Calif. 90005

[73] Assignees: Jack Bauman; Robert S. Wallace; William W. Haefliger, all of Pacific Palisades, Calif. ; a part interest

[21] Appl. No.: 397,968

[22] Filed: Aug. 24, 1989

[51] Int. Cl.[5] ..... A42B 3/12

[52] U.S. Cl. ..... 2/414; 2/410; 2/411

[58] Field of Search ..... 2/410, 411, 412, 414, 2/418, 420, 425

[56] References Cited

U.S. PATENT DOCUMENTS

| | | | |
|---|---|---|---|
| 213,157 | 1/1969 | Wallace | D87/1 |
| 2,606,708 | 8/1952 | Irvan | 229/2.5 |
| 2,732,870 | 1/1956 | Nichols | 150/0.5 |
| 2,860,768 | 11/1958 | Smithers | 206/46 |
| 3,181,766 | 5/1965 | Kane | 229/14 |
| 3,200,943 | 8/1965 | Waterbury | 206/65 |
| 3,273,779 | 9/1966 | Mykleby | 229/14 |
| 3,495,787 | 2/1970 | Wallace | 242/199 |
| 3,501,084 | 3/1970 | Harrison | 229/68 |
| 3,509,005 | 4/1970 | Hartig | 161/69 |
| 3,584,738 | 6/1971 | Wallace | 206/1 |
| 3,604,556 | 9/1971 | Schwartz | 206/1 R |
| 3,613,871 | 10/1981 | Evans | 206/1 R |
| 3,627,113 | 12/1971 | Di Iola | 206/1 R |
| 3,664,492 | 5/1972 | Wallace | 206/1 R |
| 3,773,272 | 11/1973 | Wallace | 242/55.19 A |
| 3,856,235 | 12/1974 | Wallace | 242/199 |
| 4,032,127 | 6/1977 | Lipfert | 267/151 |
| 4,166,549 | 9/1979 | Schutz et al. | 220/319 |
| 4,241,829 | 12/1980 | Hardy | 206/328 |
| 4,307,471 | 12/1981 | Lovell | 2/411 |
| 4,406,369 | 9/1983 | Wallace et al. | 206/387 |
| 4,538,301 | 9/1985 | Sawatzki et al. | 2/2 |
| 4,538,741 | 9/1985 | Jacobs | 215/320 |
| 4,696,401 | 9/1987 | Wallace | 206/594 |
| 4,766,614 | 8/1988 | Cantwell et al. | 2/414 |

FOREIGN PATENT DOCUMENTS

| | | | |
|---|---|---|---|
| 2416 | 12/1978 | European Pat. Off. . | |
| 86542 | 2/1983 | European Pat. Off. . | |
| 2115107 | 11/1970 | France . | |
| 2335168 | 7/1977 | France | 2/411 |
| 2576834 | 1/1985 | France . | |
| 1108502 | 4/1968 | United Kingdom | 2/420 |
| 1310508 | 6/1969 | United Kingdom . | |
| 1388764 | 4/1972 | United Kingdom . | |

OTHER PUBLICATIONS

European Search Report, EP 87 30 4798.

*Primary Examiner*—Werner H. Schroeder
*Assistant Examiner*—Michael A. Neas
*Attorney, Agent, or Firm*—William W. Haefliger

[57] ABSTRACT

A cushioned helmet structure comprising a helmet shell and liner; and a multiplicity of flexible fins carried by the helmet and projecting generally inwardly relative to the liner to resiliently deflect in bending when receiving loading imposed by the user's head received within the helmet.

3 Claims, 10 Drawing Sheets

SAFETY HELMET WITH FIN CUSHIONING

BACKGROUND OF THE INVENTION

This invention relates generally to helmets which firmly cushion shock loads; more particularly, it concerns a simple, rugged, helmet having cushioning means at the helmet interior, in the form of multiple, resiliently bendable fins.

There is continuing need for helmets with adequate cushioning means for the user's head. Prior helmets relied upon fabric pad cushions, but these function by compression loading, do not deflect in bending and can permanently deform to provide less cushioning.

Thus, prior helmets have not possessed the unusual advantages in construction, mode of operation and results as now afforded by the present helmet.

SUMMARY OF THE INVENTION

It is a major object of the invention to provide an improved cushioned helmet meeting the above needs, and characterized by simplicity of construction and protective and cushioning of the wearer's head through bending of fins. Basically, the helmet structure comprises:

(a) a helmet shell and liner, (b) and a multiplicity of flexible fins carried by the helmet and projecting generally inwardly relative to the liner to resiliently deflect in bending when receiving loading imposed by the user's head received within the helmet.

As will appear, the fins typically have bases integral with the helmet liner, and project inwardly, toward the helmet interior, relative to liner walls; and the fins have free terminals arranged to define a dome-shaped space within the helmet, for reception of the user's head.

Further, the thicknesses of the fins may advantageously decrease toward the free terminals, so that as the fins increasingly deflect in bending, an increasing resilient cushioning effect is produced for safety. As will be seen, the fins typically consist of molded plastic material.

Also, the fins may be carried by bendable plastic strip means shapable to the helmet liner interior surface; and the fins typically project at angles between 75° and 88° relative to planes defined by the plastic strip at the bases of the fins.

Another advantage lies in the fact that the gaps between the fins are open to provide enhanced ventilation.

These and other objects and advantages of the invention, as well as the details of an illustrative embodiment, will be more fully understood from the following specification and drawings, in which:

DRAWING DESCRIPTION

FIG. 1C is an enlarged fragmentary section taken on lines 10—10 of FIG. 7;

Figure 2:
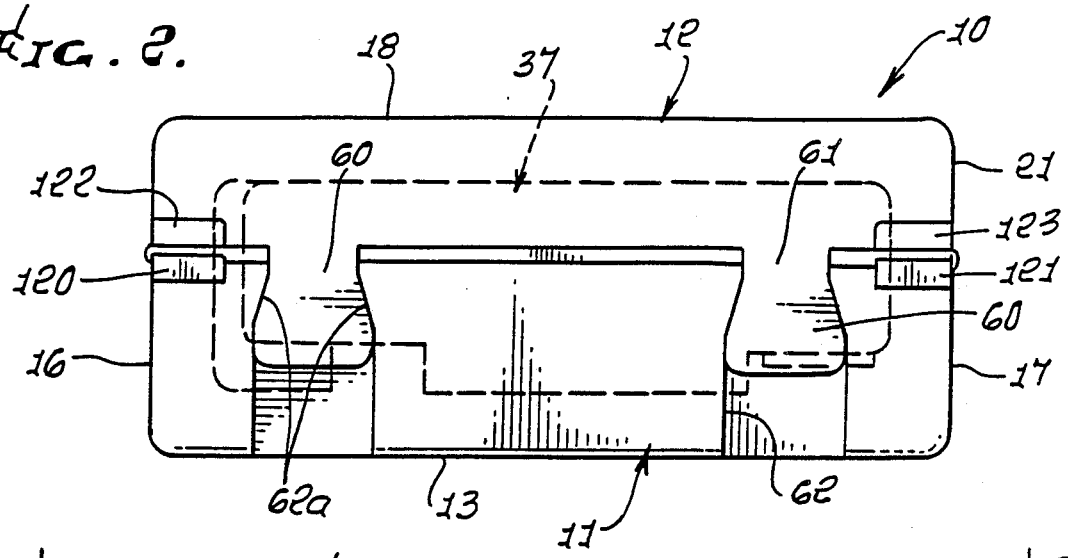
FIG. 2 is a side elevation taken on lines 2—2 of FIG. 1.
Figure 1:
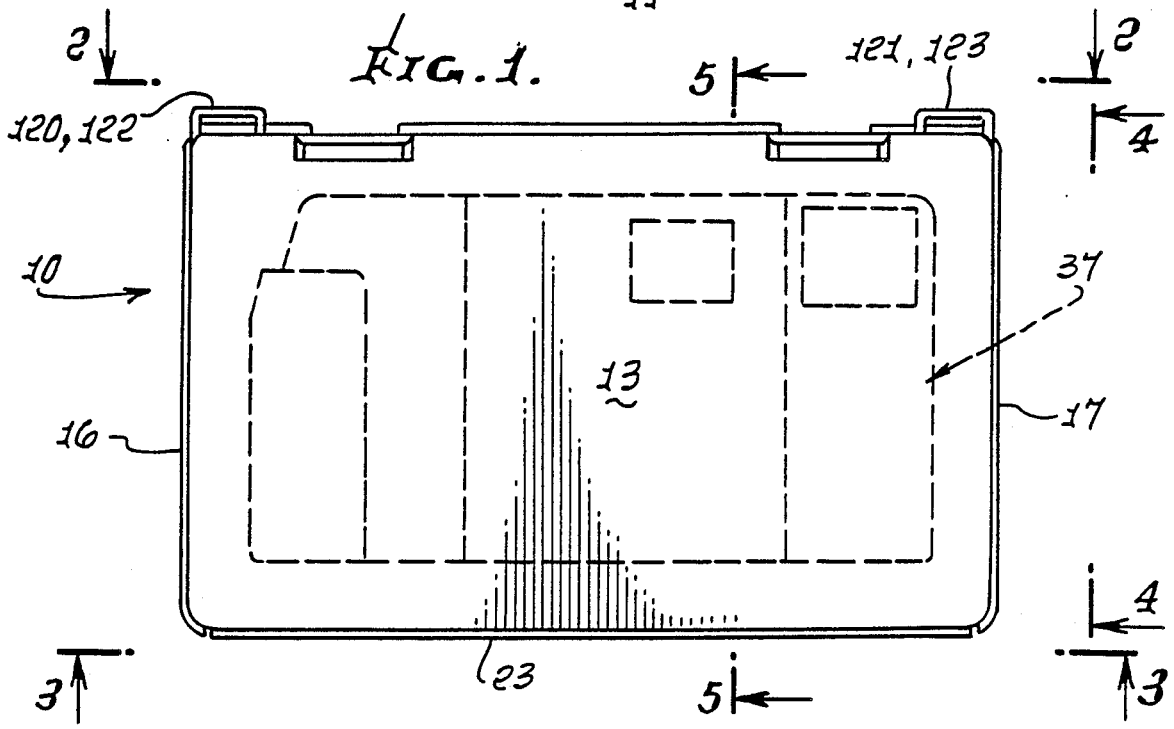
FIG. 1 is a bottom plan view of a closed container incorporating the invention.
Figure 3:
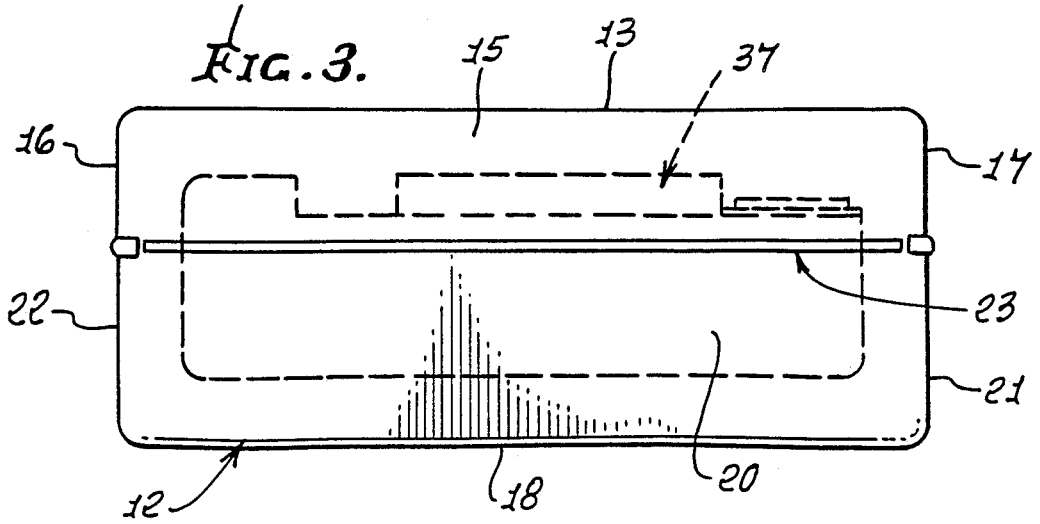
FIG. 3 is a side elevation taken on lines 3—3 of FIG. 1.
Figure 4:
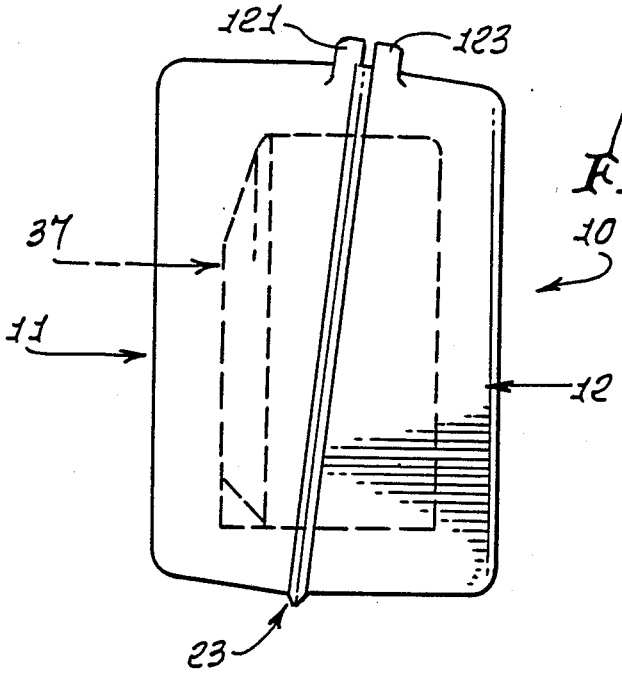
FIG. 4 is an end elevation on lines 4—4 of FIG. 1.
Figure 7:
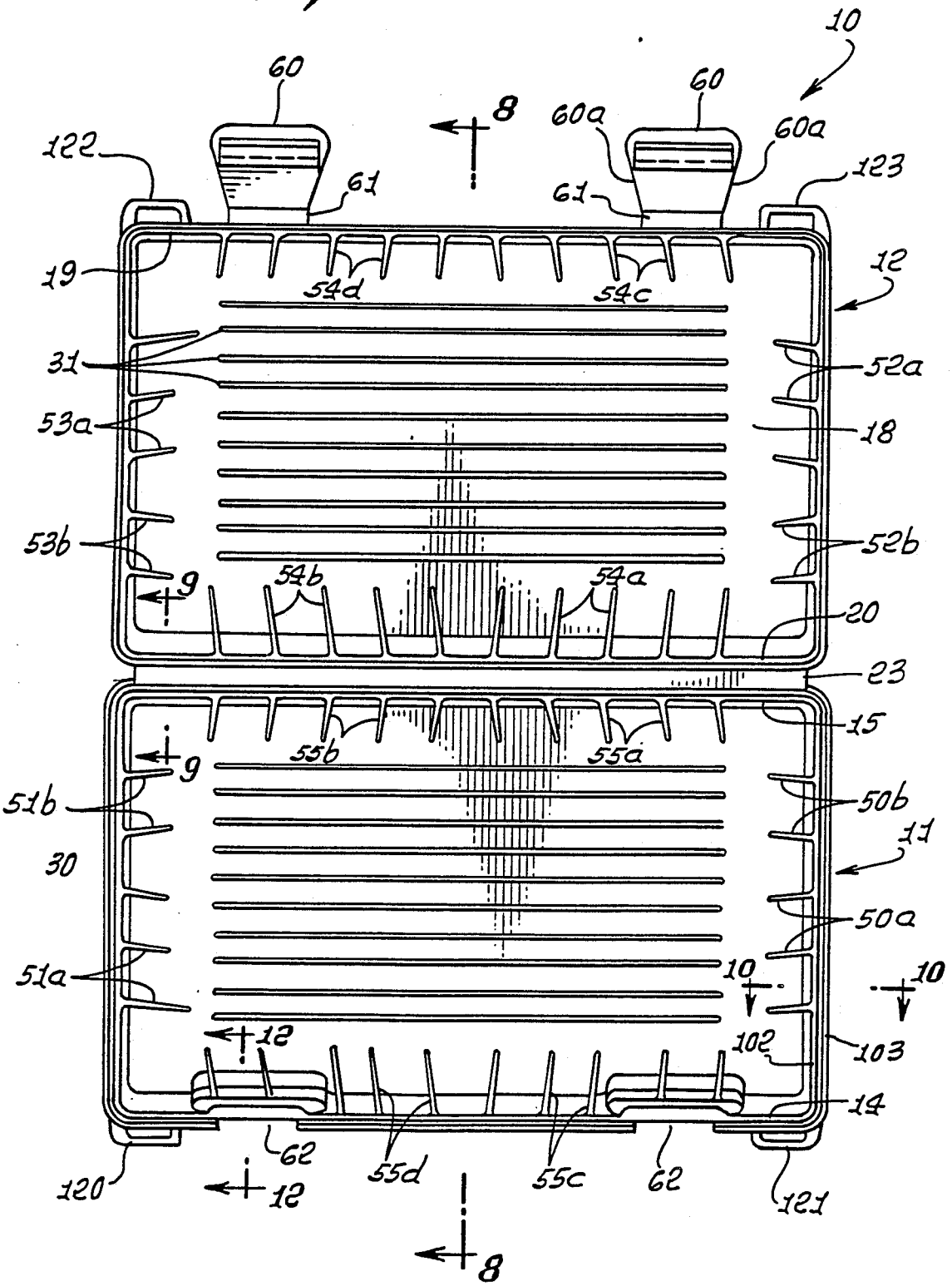
FIG. 7 is a plan view showing the interior of the receptacle and cover of the opened container.
Figure 11:
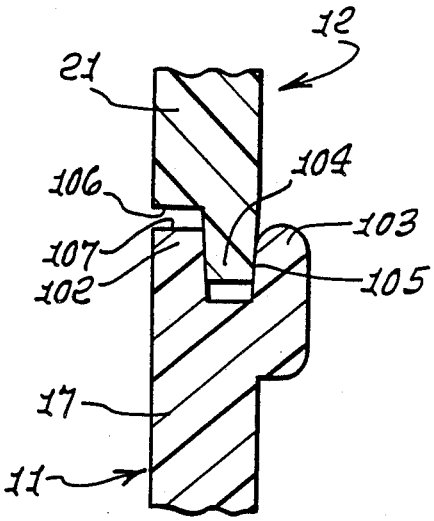
FIG. 11 is a view like FIG. 10 but showing the tongue on the cover received into a sealing groove on the receptacle.
Figure 11A:
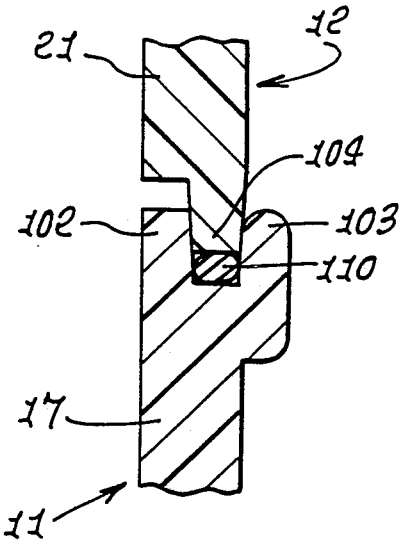
Figure 12:
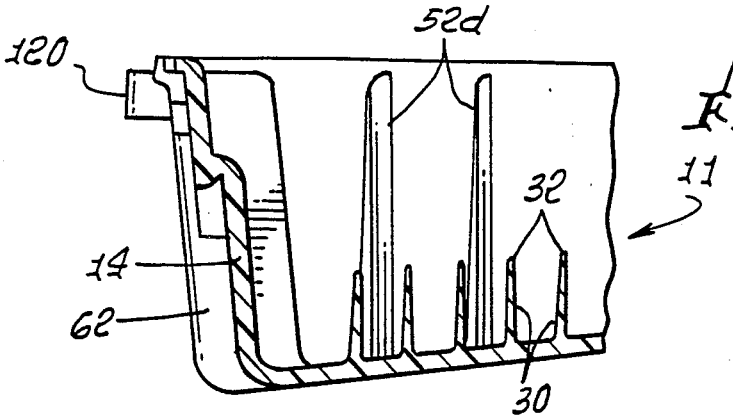
Figure 13:
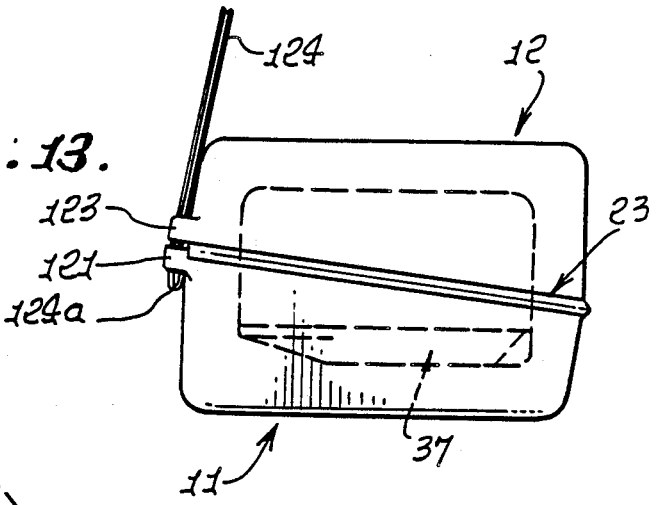
Figure 14:
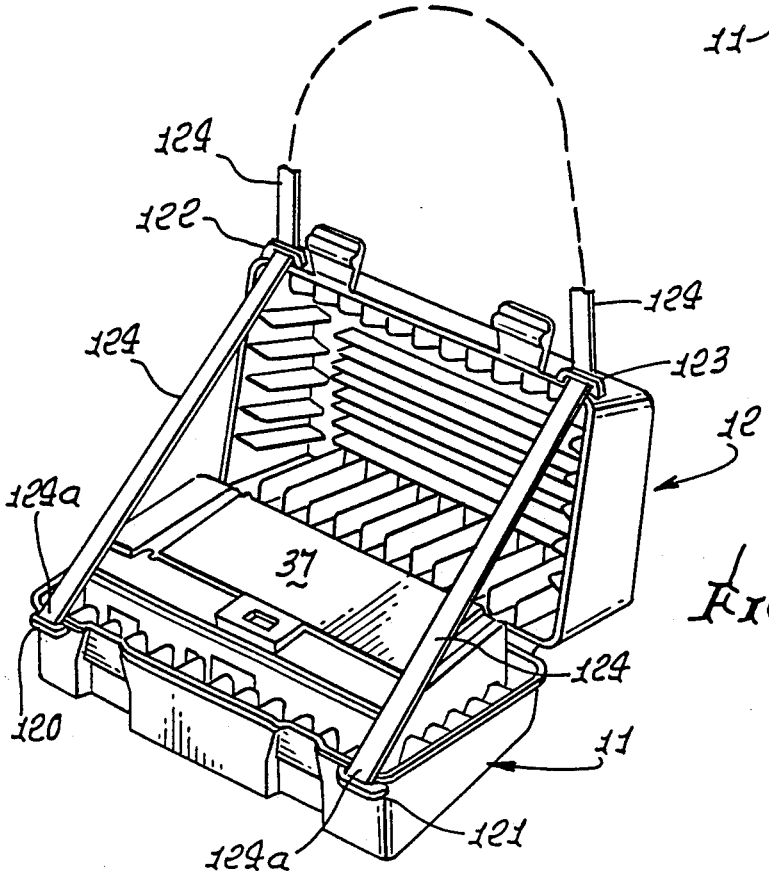
Figure 15:
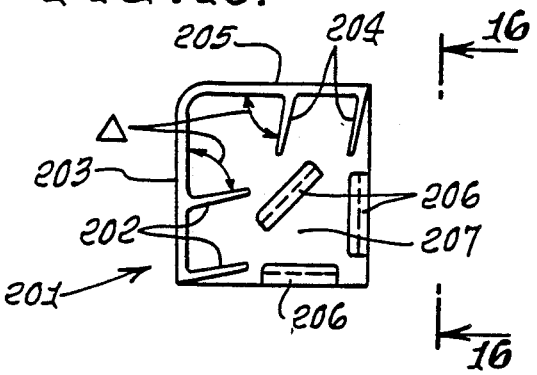
Figure 16:
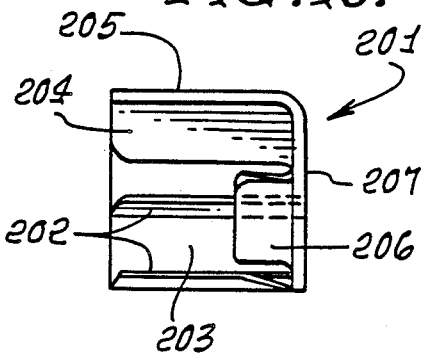
Figure 17:
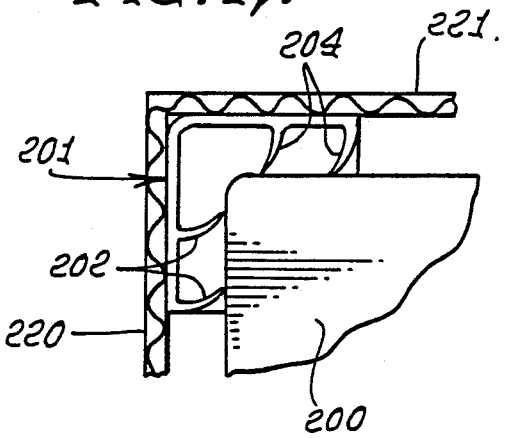
Figure 18:
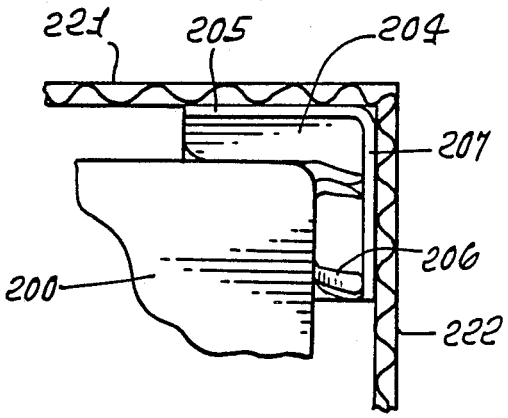
Figure 19:
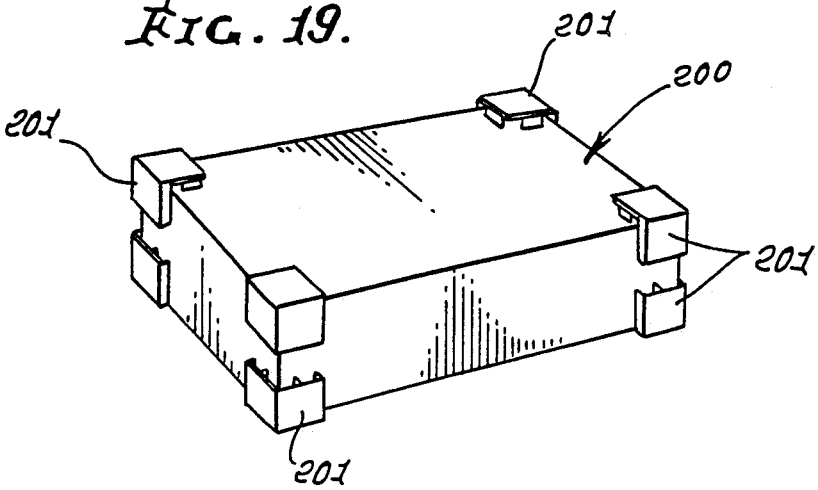
Figure 20:
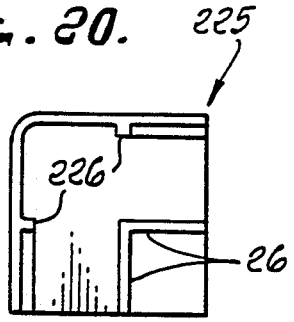
Figure 21:
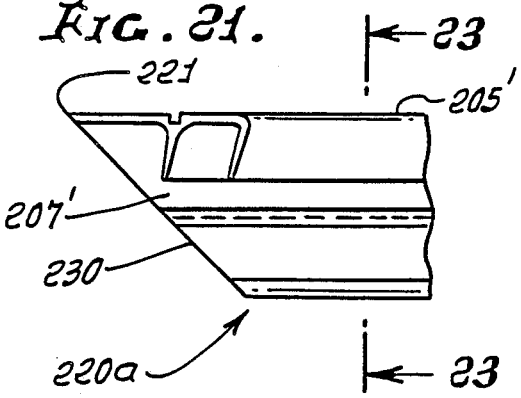
Figure 22:
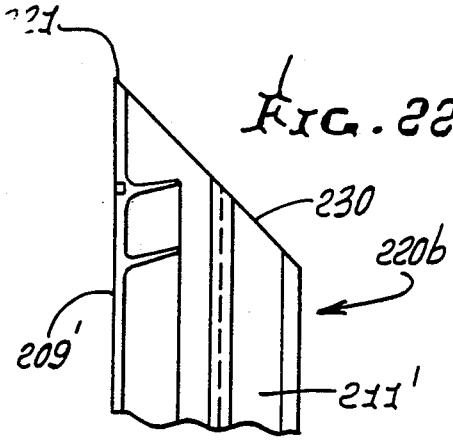
Figure 23:
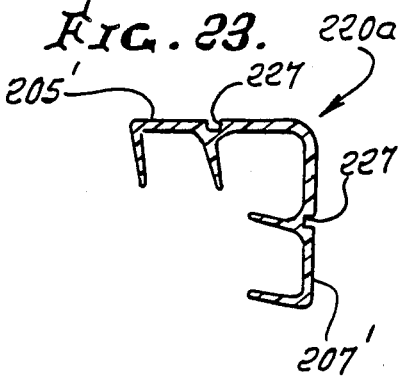
Figure 24:
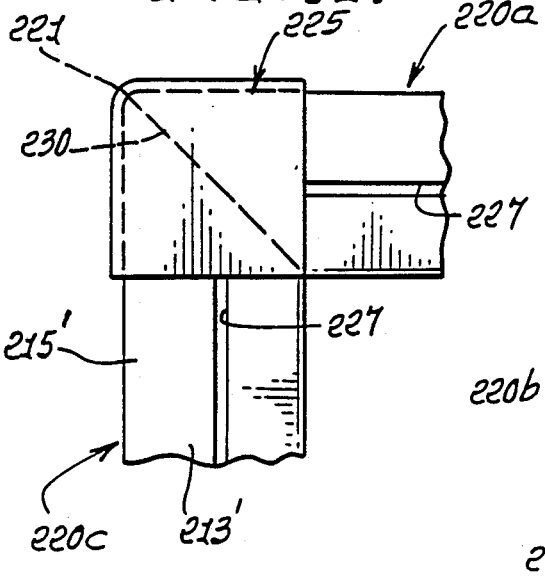
Figure 25:
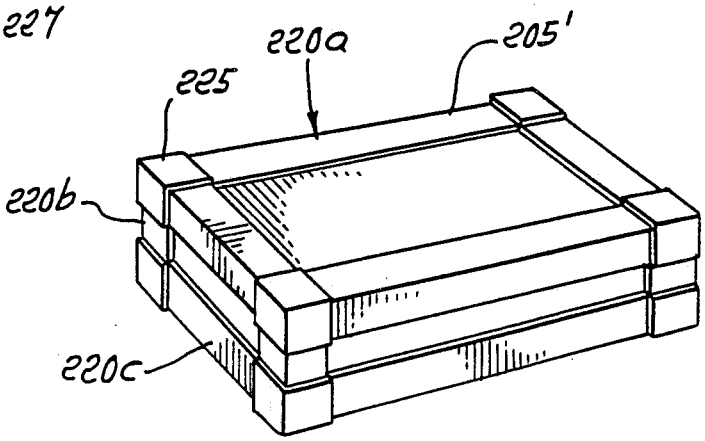
Figure 26:
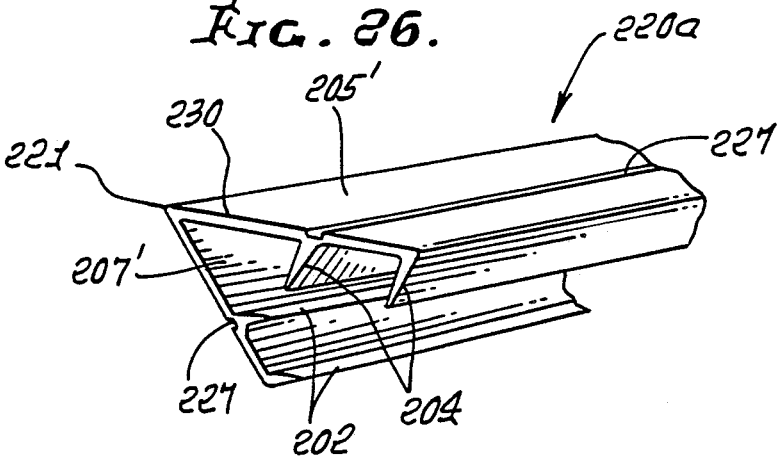
Figure 27:
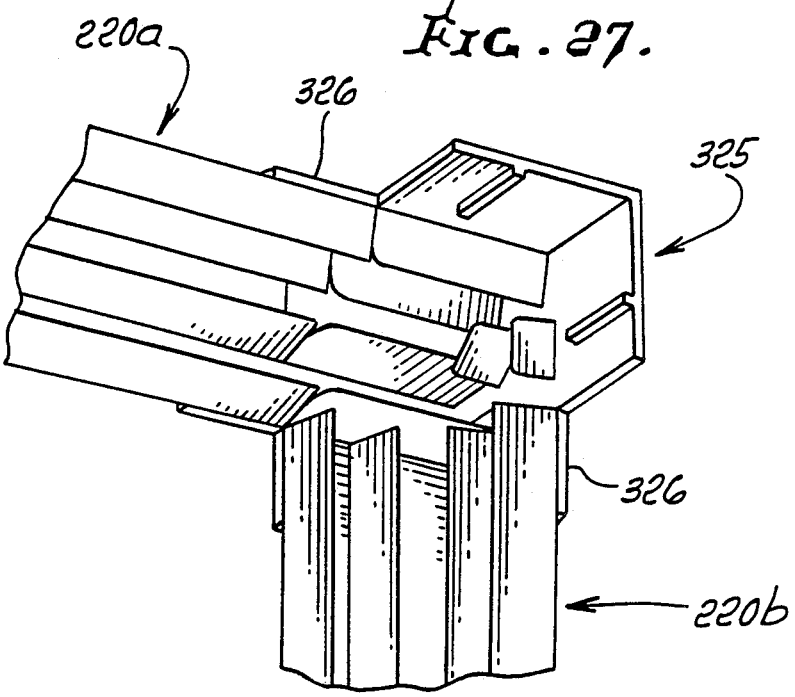
Figure 28:
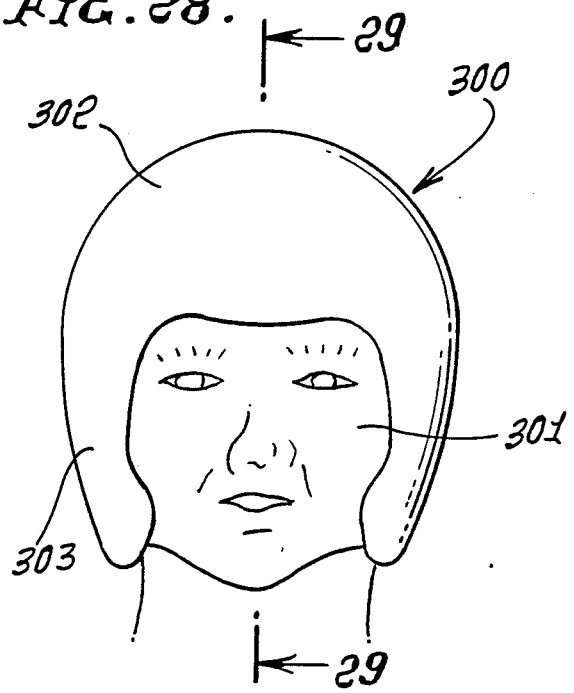
Figure 29:
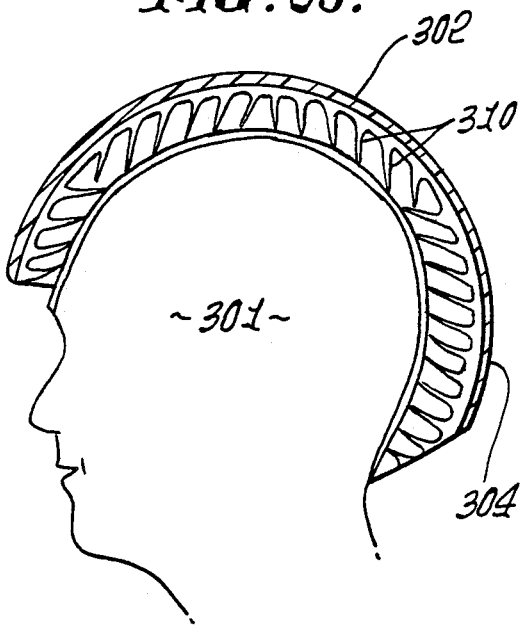
Figure 32:
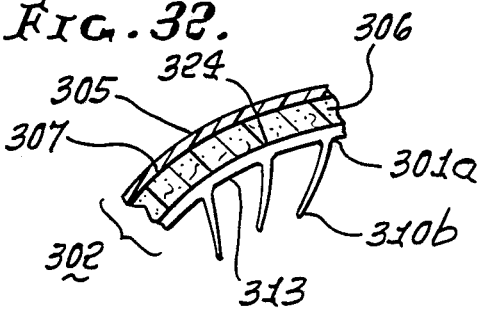
Figure 30:
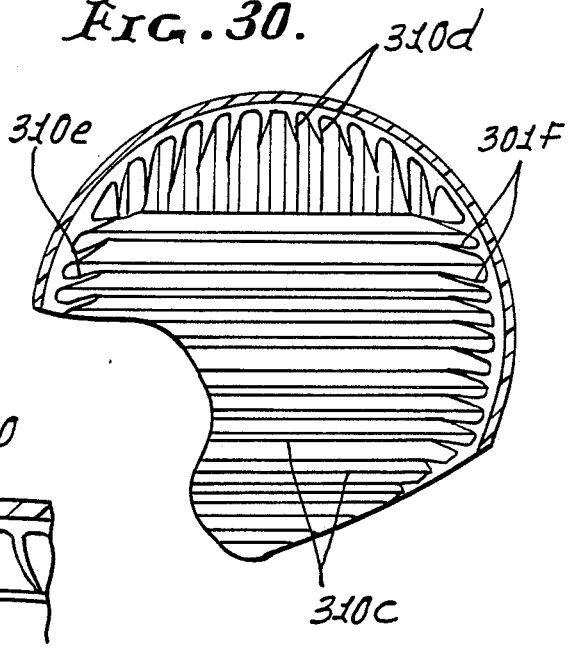
Figure 31:
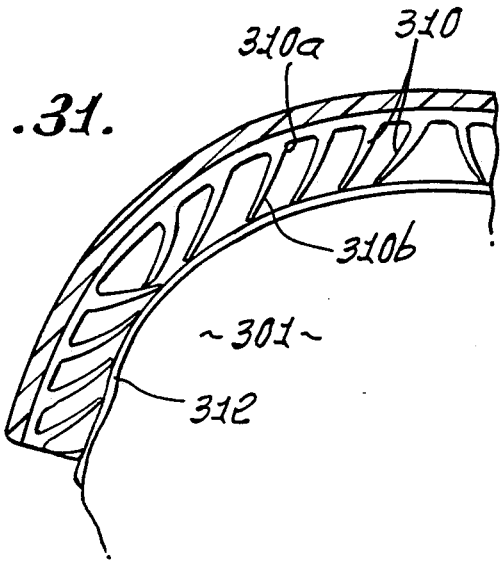

FIG. **11*a* is a view like FIG. 11** showing a modification;

FOG. **11*b* is like FIG. 11*a*** but showing a locking tab element closing a groove interruption;

FIG. 12 is an enlarged fragmentary section taken on lines 12—12 of FIG. 7;

FIG. 13 shows a support strap supporting the container via looping brackets;

FIG. 14 is like FIG. 13 but shows the container opened up and also belt supported;

FIG. 15 is an enlarged fragmentary view showing a corner protector for a case or article;

FIG. 16 is an end view on lines 16—16 of FIG. 15;

FIG. 17 is a view like FIG. 15 but showing impact on an article corner against fins protecting the case corner;

FIG. 18 is a view like FIG. 16 showing impact of the article corner impacting the fins;

FIG. 19 is a perspective view showing protective cushions applied to the case exterior corners;

FIG. 20 is a section showing a modified corner piece;

FIGS. 21 and 22 show diagonally formed protective end pieces that fit together in the FIG. 20 corner piece;

FIG. 23 is a section on lines 23—23 of FIG. 21;

FIG. 24 is a view showing assembly of the FIGS. 21 and 22 protector in a corner piece of FIG. 20 construction;

FIG. 25 shows a case like that of FIG. 19, but with protected corners of FIGS. 20–24 type, assembled to edge protect the case or article;

FIG. 26 is a perspective view of the FIG. 23 part;

FIG. 27 is a perspective view of a modification;

FIG. 28 is a front view of a helmet incorporating the invention;

FIG. 29 is a view taken in sectional elevation on lines 29—29 of FIG. 1;

FIG. 30 is a view like FIG. 29 but with the wearer's head removed from the helmet to show side wall construction;

FIG. 31 is a fragmentary view like FIG. 29 showing fin bending under shock loading imposed on the helmet; and FIG. 32 is a fragmentary section showing helmet shell, liner and fin assembly.

DETAILED DESCRIPTION

Figure 8:
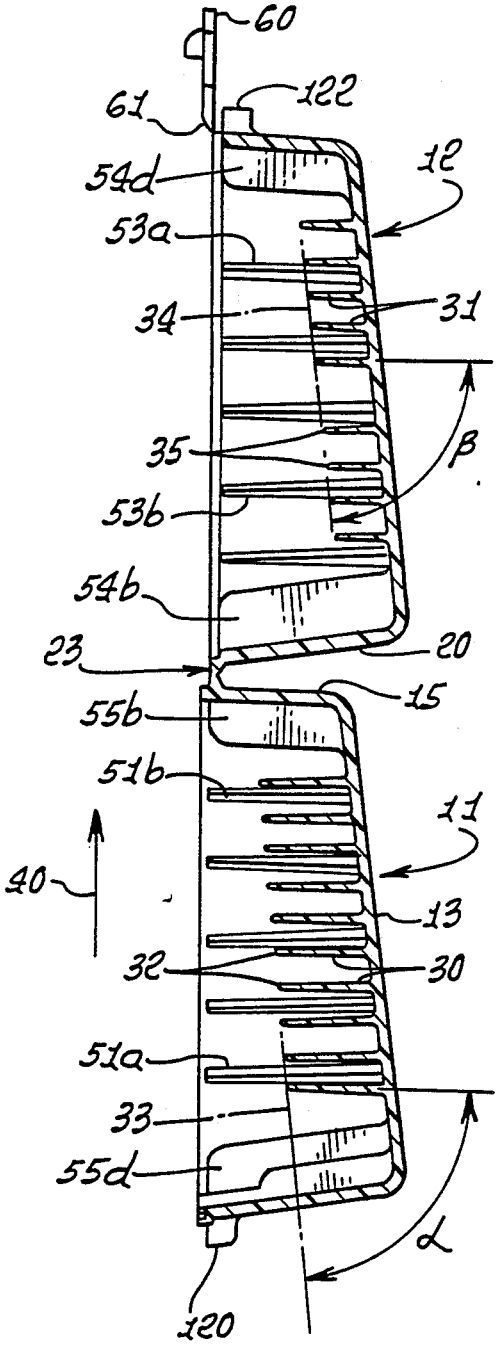
FIG. 8 is a section, in elevation, taken on lines 8—8 of FIG. 7.
Figure 9:
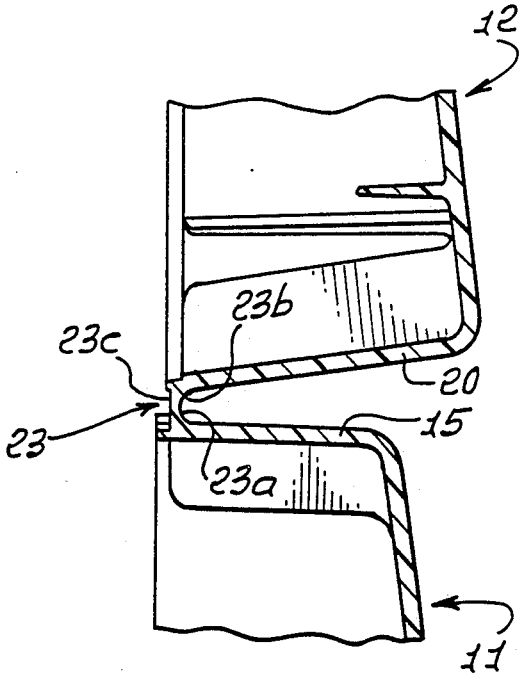
FIG. 9 is an enlarged fragmentary section taken on lines 9—9 of FIG. 7.

In the drawings, the container 10 comprises a receptacle 11 and a cover 12 therefor; the receptacle has a bottom wall 13, opposite longitudinally spaced side walls 14 and 15, and opposite laterally spaced end walls 16 and 17, and the cover has a top wall 18, opposite side walls 19 and 20, and opposite end walls 21 and 22. The container and cover typically have one-piece, molded plastic construction, with integrally molded hinge interconnection at 23. The thin-walled, molded plastic hinge 23 interconnects walls 15 and 20, and is clear from FIGS. 8 and 9, and it has two tapered extents **23*a* and 23*b*, with their thinnest extents interconnected at 23*c*. The hinge is elongated in a lateral direction, parallel to walls 15 and 20**.

Figure 5:
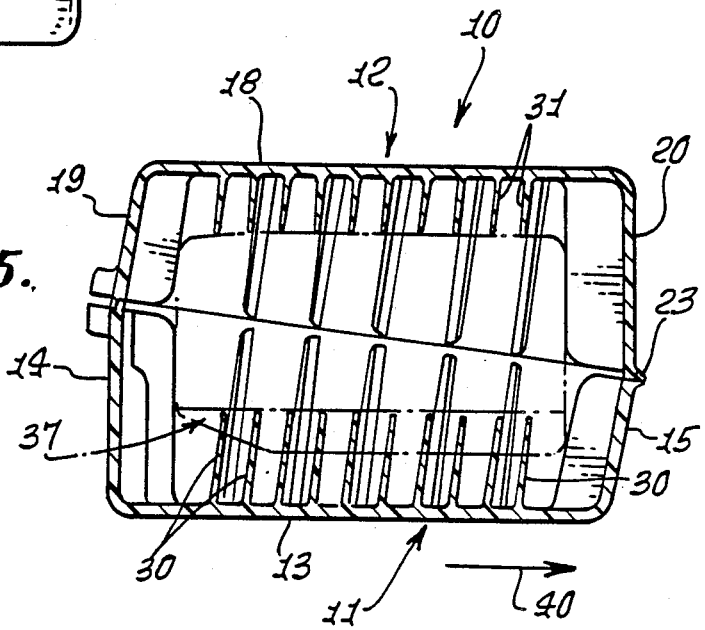
FIG. 5 is a section on lines 5—5 of FIG. 1.
Figure 6:
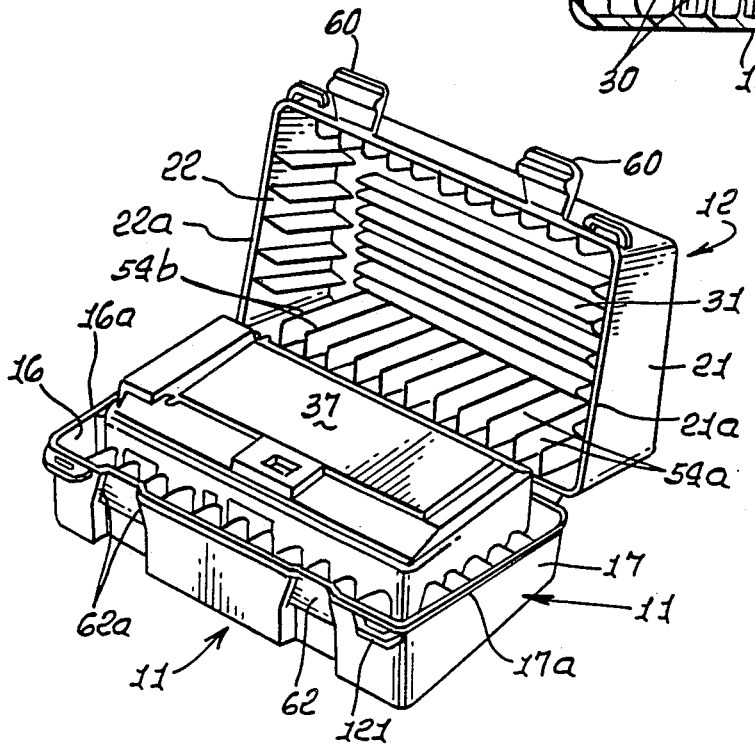
FIG. 6 is a perspective view of the FIG. 1 container, in open condition.

Fin means are provided to be integral with at least one of the top and bottom walls 18 and 13, and to project toward the other of such walls to engage an article placed within the container and between the walls when the cover is closed onto the receptacle, the fin means being yieldably deflectable in response to squeezing of the article between the walls. In the example, the fin means include first fins 30, integral with one wall, such as receptacle bottom wall 13; and second fins 31, integral with the one wall, such as cover top wall 18. The first fins 30 extend in parallel, or substantially parallel, planes and have terminal edges 32 that define an article positioning plane, or planes 33, relative to which the first fins are slightly out of perpendicularity; thus, the fins extend in lateral, upright parallel planes that extend at an angle $\alpha$ between 75° and 88° relative to plane 33; and the second fins 31 also extend in lateral, upright, parallel planes that extend at an angle or angles $\beta$ between 75° and 88° relative to an article positioning plane 34 defines by their terminal edges 35—i.e., fins 31 are slightly out of perpendicularity relative to plane 34. Such fins typically taper toward their edges 35, as is clear from FIGS. 12 and 13, to enhance their flexibility, near such edges, which typically engage and position the retained and positioned article, as for example a camera, an example of which is seen at 37 in FIGS. 5 and 6. Note also that the fins extend at correspondingly slight angles $\alpha$ and $\beta$ relative to the planes of walls 13 and 18, the article 37 extending parallel to those walls (see FIG. 5).

The receptacle, furthermore, has depth that gradually diminishes, relative to its fin height, in one longitudinal direction (see arrow 40 in FIGS. 5 and 8); and the cover has depth that also gradually increases relative to its fin height in that direction 40, in closed condition of the receptacle and cover. This enables the fin arrangement combination, as shown and described, in a highly compact container, with yieldable article cushioning and positioning fins. Note in this regard, the tapering end walls 16 and 17 with tapering edges 16*a* and 17*a* and tapering end walls 21 and 22 with tapering edges 21*a* and 22*a*.

Also provided are flexible auxiliary fins 50*a* and 50*b*, and 51*a* and 51*b* in the receptacle, and 52*a* and 52*b*, and 53*a* and 53*b* in the cover, proximate the tapered end walls as described, to position the edges of the article 37, and to slightly (flex) yield if necessary, to cushion the article nested therebetween. Fins 50*a* and 51*a* are inclined toward wall 14; fins 50*b* and 51*b* are inclined toward wall 15; fins 52*a* and 53*a* are inclined toward wall 19; and fins 52*b* and 53*b* are inclined toward wall 20. This assures that fin deflection tends to center the camera in the container. See also auxiliary fins 54*a* and 54*b* proximate wall 20; 54*c* and 54*d* proximate wall 19; 55*a* and 55*b* proximate wall 15; and 55*c* and 55*d* proximately wall 14, having similar side cushioning functions. All of such fins 50–55 project toward edges of the nested and positioned article 37.

Fastener means is associated with the receptacle and cover to hold the cover closed on the receptacle with the article squeezed by the fins, and thereby positioned with the fin means in deflected state. The fastener means advantageously may comprise interfitting tab and recess elements, one on the cover and the other on the receptacle. See for example the integral flat plastic tabs 60 having integral, folding, hinge connections at 61 to the cover wall (see FIG. 7), and recesses 62 defined by and in receptacle wall 14. The tabs and recesses are shown to have interfitting wedge shape to retain the cover closed on the receptacle, yet allow ready pull-out of the tabs, from closed, flush positions, when the cover is to be opened. See tapered edges 60*a* of the tongue, and tapered walls 62*a* of the grooves. The tabs have edges that interfere with the inner edges of the recesses, frictionally, to retain the tabs in flush, closed position, acting to lock the container closed.

Figure 10:
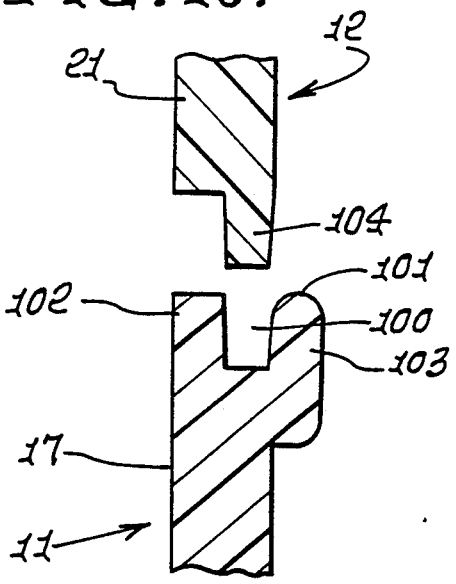

FIG. 10 shows the receptacle and cover as having interfitting peripheral edge structures that provide a fluid seal when the fastener means holds the cover closed on the receptacle and the article is squeezed by the fin means in deflected state. In this regard, the interfitting edge structure of one of the cover and receptacle forms a peripheral groove, and the peripheral edge structure of the other of the cover and receptacle forms a peripheral tongue that fits said peripheral groove when the cover is closed on the receptacle.

In the example, the peripheral groove 100 in the peripheral edge 101 of the receptacle 11 has inner and outer walls 102 and 103 that taper slightly downward; and the peripheral tongue 104 fits between those walls and exerts force acting to deflect at least one of the walls, providing a peripheral seal as to 105, about the rectangular looping extent of the container, i.e., the cover and receptacle. See FIG. 11. Edge 106 on the cover engages edge 107 on the receptacle to limit interfit of 104 in 100.

FIG. 11*a* shows a variation, wherein a looping, yieldably compressible seal 110 (such as an elastomer or rubber O-ring) is received in the groove between walls 102 and 103 to be compressed by the tongue when the cover is closed on the receptacle. Extra additional sealing effect is thereby achieved. O-ring 110 is in the form of a continuous loop, extending rectangularly about or within the channel or groove 110, at the receptacle peripheral edge.

Figure 11B:
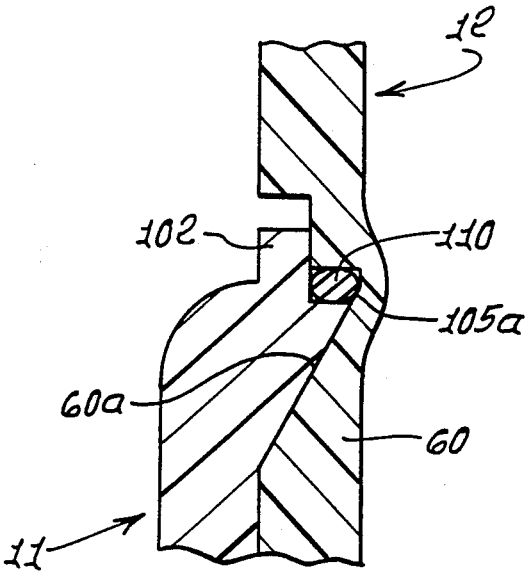

Note in FIG. 7 that the outer wall 103 of the groove 100 is intercepted or interrupted by the two recesses 62, inner wall 102 remaining intact. Thus, the outer wall has gaps therein at the recess locations. Those gaps are closed, as seen in FIG. 11*b*, by the flat tabs 60 in closed position; i.e., the tabs have inner sides 60*a* that act as substitute outer walls at the gap locations, to compress the seal 110, so that sealing effect is maintained at 105*a* against deformed O-ring 110, providing continuous sealing around the container.

FIGS. 13–14 illustrate the provision and use of looping brackets 120, 121, 122, and 123 to direct a strap 124 to hold the receptacle in horizontal position when opened, preventing dumping of a received article, such as a camera, from the container. Note in FIG. 13 the registration of openings in 120 and 122, and 121 and 123, in closed position of the container. The strap lower ends 124*a* are retained below or to brackets 120 and 121; the strap arms extend through openings in 120 and 122, and 121 and 123, and extend over the wearer's neck, and the cover 12 seats flatly against the user's head.

FIG. 15–19 show application of the invention to corners of an article 200 to be protected. Corner protectors 201 are suitably retained or attached to the article, as by the walls 220, 221 and 222 of a carton receiving the article 200 and protectors 201 at carton corners. Note fins 202 on walls 203, fins 204 on wall 205, and fins 206 on wall 207. The three walls are spacially related as follows:

wall 203 perpendicular to walls 205 and 207
wall 205 perpendicular to walls 203 and 207 wall 207 perpendicular to walls 203 and 205

Undeflected fins 202 extend in planes angled at angles Δ relative to wall 203; undeflected fins 204 extend in planes angles at angled Δ relative to wall 205; and undeflected fins 206 extend in planes angled at angles Δ relative to wall 207. Angles Δ are between 75° and 88° The article 200 engages the tips of the tapered fins or ribs, and bends them (to be cushioned) should the protector or protectors be impacted, as by dropping of the assembly and carton on the ground. FIG. 19 shows protectors 201 at each corner of the article for reception into a retaining carton. The tips of the fins may be initially bent when the protectors are received in the carton for take-up of any looseness in packing.

FIG. 20–26 show modified protectors, each with two walls diagonally split (see diagonal 230 for example) to form three like L-shaped parts 220*a, b,* and *c* elongated and with two walls tapering toward the common corner 221. The parts extend orthogonally.

TABLE

Part 220*a* includes walls 205' and 207'
Part 220*b* includes walls 209' and 211'
Part 220*c* includes walls 213' and 215'

Corner pieces 225 are guidedly attached to the outer surfaces of the six listed walls, proximate each corner. Note interior linear tongues 226 in each corner piece slidably received endwise in exterior linearly elongated grooves 227 formed in the walls 205', 207', 209', 211', 213', and 215'. Thus, a cushioning framework is provided about the block article 200, i.e., along edges thereof. Fins on parts 220*a, b,* and *c* remain as described in FIGS. 15–19. Corner pieces 225 do not contain fins.

The fins and walls in FIGS. 15–19 typically comprise a single plastic unit, and the corner pieces and elongated parts in FIGS. 20–25 define a plastic unit or frame, receivable in a carton.

An article, such as a camera, received in the internally finned case, or in the FIGS. 15–25 protectors, as described, typically resiliently deflects the fin tips on all finned sides, when the article to be protected is packaged, as described.

The unit seen in FIG. 27 is like that of FIGS. 20–26, except that the tapered ends are omitted, and the walls of each part 220*a, b,* and *c* terminate in a plane normal to such walls. Corner pieces 325 are like 225, but have internal fins as in FIGS. 15–18 to line-up with the fins in the parts 220*a–*220*c*. Extensions 326 on the corner piece walls retain and interfit the ends of parts 220*a–*220*c*.

Referring now to FIGS. 28–32, a helmet 300 is seen in FIGS. 28 and 29 receiving the wearer's head 301. The helmet includes a domed top wall 302 opposite upright side walls 303 (which are generally alike), and a curved rear wall 304. Each such wall may have the composite wall construction seen in FIG. 32 that includes a hard, durable, outer plastic, safety shell 305, and a rigid but softer plastic liner 306 bonded at 307 to the inner surface of the shell. The liner is typically thicker than the shell, as is characteristic of bicycle and motorcycle helmets.

As shown in FIGS. 28–32, a multiplicity of flexible fins or ribs is carried by the helmet and projecting generally inwardly relative to the liner to resiliently deflect in bending when receiving loading imposed by the user's head received within the helmet. As shown, the fins 310 are generally the same as described earlier in regards to FIGS. 7–9, and FIGS. 15–17; i.e., the fins extend at between about 75° and 88° relative to planes at the bases 310*a* of the fins. Those planes are formed by the strip or strips that carry the fins, or by the liner in the event the ribs are directly connected to or integral with the liner. Therefore, the fins preferably deflect in bending when the user's head is received in the helmet as seen in FIG. 31. A thin, flexible spacer 312 may be received in the helmet at the tips of the fins to further protect the wearer's head and transfer loading between the fins and the head.

Note that the thicknesses of the fins decrease between the bases 310*a* and the free terminals 310*b* of the fins, whereby the plastic molded fins bend with increasing curvature toward the terminals to enhance their resilient flexing capability. The fin bases may be integral with a strip or strips as seen at 313 in FIG. 32, the strip or strips bonded to the liner 306, at 324. Such strips enable curved connection of the strips to the liner domed inner surface.

FIG. 30 shows the parallel, forward to rearward arrangement of the fins 310*c* at the inner sides of the helmet; the parallel side-to-side transverse (front inner top of the helmet 310*d*; the parallel side-to-side transverse (and up and down spaced) arrangement of the fins 310*e* at the inner forward extent of the helmet; and the parallel side-to-side (and up and down spaced) arrangement of the fins 310*f* in the fins at the rear inner side of the helmet. All fins project rearwardly relative to the helmet shell and liner.

The invention is particularly applicable to cyclist's helmets and football helmets, as well as other types of helmets.

I claim:

1. A cushioned helmet structure comprising in combination (a) a helmet shell and liner, (b) and a multiplicity of flexible planar fins carried by the helmet and projecting generally inwardly relative to the linear to resiliently deflect in bending when receiving loading imposed by the user's head received within the helmet, (c) the fins having bases integral with the liner, and the liner defining a top wall and opposite side walls, and the fins projecting inwardly relative to said walls, the fins also having free terminals arranged to define a dome-shaped space within the helmet for reception of the user's head.

(d) the thickness of each fin decreasing toward a terminal defined by the fin, the fin terminal and base both being elongated in a direction parallel to the linear proximate the fin base.

(e) and each fin projecting away from said liner at an angle between about 75° and 88°, relative to and proximate the liner, in unflexed condition of the fin.

2. The combination of claim 1 wherein the fins consist of molded plastic material.

3. The combination of claim 1 wherein the fins include:

(i) fins extending generally forwardly and spaced up and down at opposite sides of the helmet;

(ii) fins extending transversely and spaced front to rear at the upper interior of the helmet;

(iii) and fins extending transversely and spaced up and down at the front and rear interior of the helmet.

* * * * *